US010161155B2

(12) United States Patent
Lopez et al.

(10) Patent No.: US 10,161,155 B2
(45) **Date of Patent: *Dec. 25, 2018**

(54) SEISMIC PROTECTIVE STRUCTURE FOR BOARD PARTITIONS

(71) Applicant: Etex Building Performance International SAS, Avignon (FR)

(72) Inventors: Pauline Lopez, Avignon (FR); Roger Arese, Isle sur la Sorgue (FR)

(73) Assignee: Etex Building Performance International SAS, Avignon (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/531,180

(22) PCT Filed: Dec. 14, 2015

(86) PCT No.: PCT/EP2015/079641
§ 371 (c)(1),
(2) Date: May 26, 2017

(87) PCT Pub. No.: WO2016/096756
PCT Pub. Date: Jun. 23, 2016

(65) Prior Publication Data

US 2017/0362847 A1 Dec. 21, 2017

(30) Foreign Application Priority Data

Dec. 19, 2014 (EP) ..... 14290396
Jan. 16, 2015 (WO) ..... PCT/EP2015/050805

(51) Int. Cl.
*E04B 1/68* (2006.01)
*E04B 2/72* (2006.01)
(Continued)

(52) U.S. Cl.
CPC ..... *E04H 9/02* (2013.01); *E04B 1/68* (2013.01); *E04B 2/72* (2013.01); *E04B 2/74* (2013.01); *E04B 2/7457* (2013.01); *E04B 2/828* (2013.01)

(58) Field of Classification Search
CPC ..... E04H 9/02; E04B 2/72
See application file for complete search history.

(56) References Cited

U.S. PATENT DOCUMENTS 5,666,775 A 9/1997 Shreiner et al.
6,430,884 B1 8/2002 Shreiner et al.
(Continued)

FOREIGN PATENT DOCUMENTS

EP 2 886 748 A1 6/2015
JP H06-1520 U 1/1994
(Continued)

OTHER PUBLICATIONS

International Search Report for PCT/EP2015/079641 (dated 2016; 5 pages).*

*Primary Examiner* — Rodney Mintz
(74) *Attorney, Agent, or Firm* — Dilworth & Barrese, LLP

(57) ABSTRACT

A seismic protective structure (100) for protecting a board partition (190). The protective structure (100) comprises a first stud (110), a second stud (120), and a wedge (140). The first stud (110) is mounted against a neighboring wall (150) and the second stud is being positioned spaced from the first stud so that a protective board (130) is mounted on the first stud and the second stud. The structure also comprises a wedge (140) mounted and positioned against the second stud (120) such that the protective board (130) mounted on the first (110) and second stud (120) is pushed at least partly out
(Continued)

of the plane of the board partition (190) by the wedge (140) when a given level of seismic stress is appearing.

15 Claims, 11 Drawing Sheets

(51) Int. Cl.

| | |
|---|---|
| ***E04B 2/74*** | (2006.01) |
| ***E04B 2/82*** | (2006.01) |
| ***E04H 9/02*** | (2006.01) |

(56) References Cited

U.S. PATENT DOCUMENTS

| | | | | |
|---|---|---|---|---|
| 9,145,906 | B2 * | 9/2015 | Schuit | F16B 7/0446 |
| 9,834,924 | B2 * | 12/2017 | Lopez | E04B 1/98 |
| 2016/0319539 | A1 * | 11/2016 | Lopez | E04B 2/828 |
| 2016/0333575 | A1 * | 11/2016 | Lopez | E04B 1/98 |

FOREIGN PATENT DOCUMENTS

| | | | | |
|---|---|---|---|---|
| JP | 2006-265821 | A | 10/2006 | |
| WO | WO 2015091997 | A1 * | 6/2015 | E04B 2/828 |
| WO | WO 2015092001 | A1 * | 6/2015 | E04B 1/98 |

* cited by examiner

SEISMIC PROTECTIVE STRUCTURE FOR BOARD PARTITIONS

FIELD OF THE INVENTION

The present invention relates to the field of board partitions. More specifically it relates to a protective structure for limiting damage to board partitions caused by earthquakes.

BACKGROUND OF THE INVENTION

In earthquake sensitive regions, buildings are often designed and constructed to withstand earthquake movements or to reduce the damage to their structural construction caused by such earthquake movements. Earthquake movements typically induce horizontal and vertical movements and come in waves.

Whereas a lot of attention has been given to design and construction of the outside structure of buildings, also the inner walls typically get damaged during earthquakes.

Inner walls typically may be constructed as plasterboard partition walls, which are built using a sub-structure made of e.g. wood or metal studs, on which plasterboards are mounted. During an earthquake these board partition walls can collapse or break due to forces on the plasterboard partition walls. More particularly, movements of the building during an earthquake typically may induce deformation of the sub-structure of the partition wall, resulting in damage to both the plasterboard wall as well as to the underlying sub-structure.

Japanese utility model application JPH061520 describes one solution for reducing damage to a partition by adjusting the connection of the partition with other walls that induce stress on the partition during earthquakes. The connection is made using a linking device having an accordion-like structure allowing relative movement between the inner walls. In some particular embodiments, the linking device may be an attachment/detachment device that links the walls but that can be released when a predetermined force or larger is applied, e.g. during an earthquake. The linking device might for example be a door that is kept close using magnets and that opens when a too large force is applied. Such a system is also known from U.S. Pat. No. 6,430,884, which describes an automatically closing cover panel for a seismic expansion joint. However, such systems require the presence of a relatively wide expansion joint in the board partition, which is not always desirable.

Another solution is to construct the board partition structure freely from the remaining building structure, i.e. by leaving gaps between the partition structure and the remaining building structure. The space (deflection gap) between both typically then is filled with a flexible joint. This method works well for small partitions, but if the movements of the building surpass the space filled with the flexible joints, the partition structure will eventually break.

SUMMARY OF THE INVENTION

It is an object of the present invention to provide a system and method for limiting damage to board partition walls so as to prevent breaking or damaging of entire board partitions when stress is applied to it, e.g. during earthquakes.

The above objective is accomplished by a method and device according to the present invention.

The present invention relates to a seismic protective structure for protecting a board partition, the protective structure comprising:

a first stud and a second stud, the first stud being mounted against a neighbouring wall and the second stud being positioned spaced from the first stud so that a protective board is mounted on the first stud and the second stud, and a wedge being mounted and positioned against the second stud such that a protective board mounted on the first and second stud is pushed (at least) partly out of the plane of the board partition by the wedge when a given level of seismic stress is appearing. More particularly, the protective board is pushed completely or partially out of the plane of the board partition by the wedge, when the first stud and second stud are moved towards each other. Such movement of the studs relative to each other may occur due to seismic stress. For example, seismic stress may induce movement of the first stud towards the second stud.

The first and second stud preferably are upright or standing studs, most preferably vertically arranged studs.

In preferred embodiments, the protective board (130) is fixed on the first stud (110) and the second stud (120) via fixing means, such as screws.

In particular embodiments, the seismic protective structure (100) described herein is adapted for, when a given level of stress is appearing, intentionally causing damage to the protective board (130), thereby releasing pressure from the remainder of the board partition (190). More particularly, the protective board is damaged when it is pushed (at least) partly out of the plane of the board partition by the wedge.

The seismic protective structure described herein allows for minimizing damage to board partition walls such as plasterboard walls, without requiring the provision of expansion joints or gaps. Accordingly, partition walls with an even surface with a homogeneous appearance can be obtained. Moreover, partition walls comprising the seismic protective structure described herein can be easy to install.

It is an advantage of embodiments of the present invention that the pressure on the board partition caused by moving the first stud towards the second stud is removed by pushing the protective board out of the plane of the board partition. It is an advantage of embodiments of the present invention that the wedge is mounted on the second stud instead of the first stud because the protective board is pushed in the open space when being pushed away from the second stud. In case the wedge is mounted on the first stud the protective board could be pushed against the neighbouring wall against which the first stud is mounted.

In particular embodiments, the wedge is mounted and positioned against the second stud such that a protective board mounted on the first and second stud is pushed only partly out of the plane of the board partition by the wedge when a given level of seismic stress is appearing. For example, only one or more corner parts of the board partition may be pushed out of the plane of the board partition.

Accordingly, the protective board may comprise an upper and a lower corner part whereby the upper and/or lower corner part is mounted against the first stud and the second stud such that (only) the upper corner part and or lower corner part is pushed by the wedge out of the plane of the board partition when a given level of seismic stress is appearing. It is preferred that only the upper corner part and/or lower corner part is pushed out of the plane of the board partition, thus leaving the remainder of the partition wall intact. Accordingly, in such embodiments, the upper corner part and/or lower corner part will be separated at least partially from the remainder of the partition wall when a given level of seismic stress is appearing. It is an advantage of embodiments of the present invention that only the corner parts of the protective boards are breaking under a seismic load. It is an advantage that only these parts need to be replaced after a seismic shock. It is an advantage of embodiments of the present invention that only the protective board, or even only the corner part of the protective board needs to be replaced (and filling of the joints) after a seismic shock. During a seismic shock the protective board or corner part of the protective board breaks first, releasing the pressure from the rest of the board partition. Thereby the rest of the board partition is protected from being damaged for larger displacements of the first stud than in the case no protective board and wedge would be present. It is an advantage of embodiments of the present invention that the protective structure is functioning as good after a replacement than after being installed for the first time.

Typically, for each of the first and second corner parts, a first side of the corner part is mounted to the first stud, whereas an opposing side of the corner part is mounted to the second stud. It is further provided that each of the upper corner part and the lower part may be provided with its own (dedicated) wedge. Accordingly, the upper corner part may be provided with an upper wedge, whereas the lower corner part is provided with a lower wedge. The upper wedge and lower wedge are separate wedges (i.e. do not form a single continuous wedge). The upper and lower wedges may be provided as separate parts; or the upper and lower wedges may be present on a single part, e.g. a single profile comprising the upper and lower wedges.

Preferably, the wedges are preferably only provided along the corner parts, and not along other parts of the protective board.

In particular embodiments, said protective board (130) is configured such that said upper corner part (1010) and/or lower corner part (1020) are at least partially separated from the remainder of the protective board (130), when pushed out of the plane of the board partition (190).

In certain embodiments, said upper corner part (1020) and/or said lower corner part (1020) are provided as separate parts; or be connected to the remainder of the protective board via a weakened connection, e.g. a thinner and/or perforated part of the protective board.

In particular embodiments, the height of the upper and/or the lower corner part (1010, 1020) is 0.1 to 0.3 times the height of the board partition (190).

In embodiments according to the present invention the length of the wedge may be smaller than the height of the protective board, so that the wedge does not extend over the full height of the protective board. In certain embodiments, the wedge (140) is provided only along said upper and/or lower corner part (1010). In other embodiments, the wedge may be present over the complete height of the protective board.

It is an advantage of embodiments of the present invention that the board partition can be protected by a protective structure at each wall. It is an advantage of embodiments of the present invention that a double sided board partition can be protected on each side.

An additional part may be mounted back to back with the second stud. It is an advantage of embodiments of the present invention that the stud area for mounting the wedges is enlarged. This makes it more easy to mount the wedges and this makes more firm mounting of the wedges possible. It is an advantage of embodiments of the present invention that the second stud is reinforced with an additional part. The makes the second stud less prone to being damaged by forces of the protective board.

The board partition may comprise multiple layers of boards, also referred to herein as "board layers".

The height of the wedge may be smaller than the thickness of the at least one mounted board layer.

The edge of the protective board, or a corner part thereof, may be slanted such that it is parallel with the wedge when mounted against the wedge.

It is an advantage of embodiments of the present invention that the outward force of the wedge on the protective board is spread over the slanted area of the protective board. This has as advantage that the forces of the protective board on the wedge and thus on the second stud are spread in a more uniform way. Therefore it is less probably that the second stud and the wedge gets damaged by the protective board when it is pushed against the wedge by the wall.

In particular embodiments, the seismic protective structure may comprise a double wedge structure such that when mounting the double wedge structure against the second stud, a wedge is present on both sides of the second stud. It is an advantage of embodiments of the present invention that by integrating two opposite wedges into one piece, mounting the two wedges on a stud can be simplified. Fastening the double wedge also requires less fastening means (e.g. screws) than fastening the two separate wedges. It is moreover easier to position the double wedge as positioning only requires pushing the wedge around the stud until a fixed position. The double wedge only needs to be positioned along the length of the stud.

The seismic protective structure may comprise a sliding layer being applied to the wedge for decreasing the friction between the wedge and the protective board. It is an advantage of embodiments of the present invention the protective board has less friction with the wedge. This decreases the forces, parallel with the board partition, of the protective board on the wedge and thus also on the second stud. Therefore it is less probable that the protective board damages the second stud.

The present invention also relates to a board partition comprising a seismic protective structure as described above.

The board partition may be double sided having a protective board at each side of the board partition and the board partition may comprise two seismic protective structures each comprising a double wedge structure, whereby wedges are present on both sides of the board partition and along the full length of each longitudinal side of the protective boards.

The board partition may be double sided having a protective board at each side of the board partition and the board partition may comprise four seismic protective structures each comprising a double wedge structure, whereby wedges are present on both sides of the board partition and in each corner of the protective boards.

The present invention furthermore relates to a kit of parts for constructing a seismic protective structure as described above, the kit of parts comprises one or more wedges, at least one protective board, a first stud, and a second stud for constructing a board partition adapted for pushing the protective board at least partly out of the plane of the board partition by the wedge when a given level of seismic stress is appearing.

The present invention also relates to a method for protecting a board partition against a given level of seismic stress, the method comprising using in the board partition a seismic protective structure as described above such that, when a given level of seismic stress is appearing, a protective board is pushed at least partly out of the plane of the board partition by a wedge mounted on a second stud of the seismic protective structure. In preferred embodiments, the protective board is pushed only partly out of the plane of the board partition. More particularly, (only) an upper and/or lower corner part of the protective board may be pushed out of the plane of the board partition.

The present invention also relates to a method for restoring a board partition after an earthquake, the board partition comprising a seismic protective structure as described above, the method comprising replacing the protective board or the upper or lower part of the protective board.

Particular and preferred aspects of the invention are set out in the accompanying independent and dependent claims. Features from the dependent claims may be combined with features of the independent claims and with features of other dependent claims as appropriate and not merely as explicitly set out in the claims.

These and other aspects of the invention will be apparent from and elucidated with reference to the embodiment(s) described hereinafter.

Figure 1:
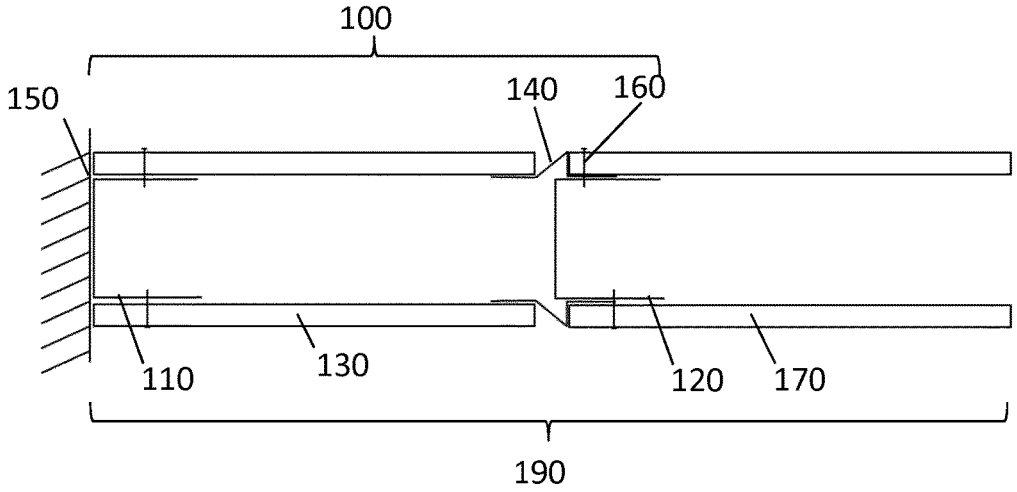
FIG. 1 provides a schematic top view of a protective structure in between a wall and the rest of the board partition in accordance with a first embodiment of the present invention.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Where in embodiments according to the present invention reference is made to a wall, reference is made to the wall against which the board partition is fixed. In embodiments according to the present invention the board partition may be fixed between two walls. Movements of these walls may cause the board partition to break.

Where in embodiments of the present invention reference is made to a protective board, reference is made to a full board whereby the board or edges thereof operate as fuse for protection upon seismic activity, or to one or more boards covering only one or more corners and operating as fuse for protection upon seismic activity or even to an assembly of one or more boards covering one or more corners and one or more additional boards positioned in between so as to cover the full height of the wall. Accordingly, the term "corner part" as used herein refers to a part of the protective board, which forms a corner of the partition wall. As the protective board may be only present along a part of the width of the entire partition wall, the width of the corner part will typically be only a fraction of the width of the partition wall, whereas the width of the corner part may be equal to or less than the width of the board partition. In other words, even if the corner part is only present along a part of the width of the partition wall, it may be present along the entire width of the protective board. The height of the corner part will typically be only a part of the total height of the protective board or of the partition wall. Preferably each of the upper corner part and the lower corner part independently has a height which is from 0.1 to 0.3 times the height of the partition wall.

The combination of the protective board and the wedge, which causes the protective board to move partially or completely out of the plane of the board partition thereby relieving stress from the board partition, is also referred to as a mechanical fuse.

In a first aspect the present invention relates to a seismic protective structure 100 for protecting a board partition 190. The seismic protective structure 100 comprises a first stud 110, a second stud 120, a wedge 140, and a protective board 130. The first stud 110 is mounted against a wall 150. The wedge 140 is mounted against the second stud 120 and the protective board 130 is mounted against the first stud 110 and the wedge 140, the protective board 130 is pushed by the wedge 140 at least partly out of the plane of the board partition 190 when the first stud 110 is pushed by the wall 150 towards the second stud 120.

As described above, the board partition described herein may be fixed between two walls, e.g. a first wall and a second wall. In such embodiments, the first stud may be mounted against the first wall, whereas the second stud preferably is a freestanding stud. This means that the second stud is not mounted against the first or second wall, but positioned between (and spaced apart from) the first and second wall.

By way of illustration, embodiments of the present invention not being limited thereto, standard and optional features will be illustrated using exemplary embodiments. FIG. 1 shows a seismic protective structure 100 for protecting a board partition 190. In FIG. 1 a top view of a board partition 190 is shown wherein the protective board 130 is mounted on a first stud 110, whereby the first stud is mounted against a wall 150. The protective board 130 is also mounted against a wedge 140 and the wedge is mounted against a second stud 120. The wedge 140 is mounted such that, when moving the first stud 110 towards the second stud 120, the protective board 130 is pushed away from the second stud 120 by the wedge 140. Thereby the pressure on the board partition 190, caused by the movement of the first stud 110 towards the second stud 120 is removed from the boards of the board partition 190. In embodiments according to the present invention, as for example in the embodiment illustrated in FIG. 1, the board partition 190 has boards on both sides of the studs and therefore on each side of the second stud 120 a wedge 140 is mounted.

Figure 23:
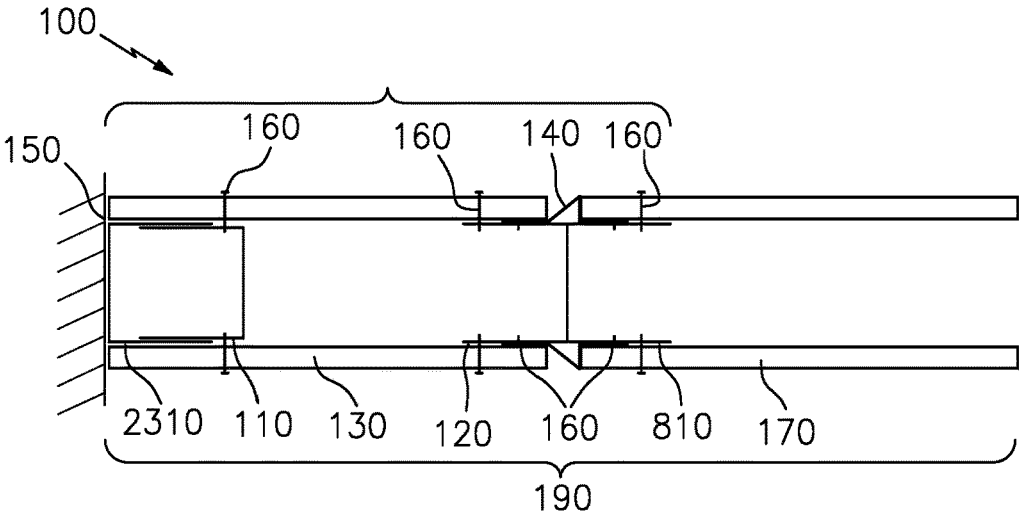
FIG. 23 provides a schematic top view of a protective structure in between a wall and the rest of the board partition in accordance with a first embodiment of the present invention.

FIG. 23 shows another protective structure 100 for protecting a board partition 190. In FIG. 23 a top view of a board partition 190 is shown wherein the protective board 130 is mounted on a first stud 110, whereby the first stud 110 is positioned in a vertical track 2310 which is mounted against a wall 150. Accordingly, in the seismic protective structure described herein the first stud may be directly or indirectly mounted against a neighbouring wall. The protective board is fixed using screws 160 against the first stud 110. The first stud 110 can be guided by the vertical track 2310. In embodiments according to the present invention the first stud 110 is not fixed against the vertical track 2310. In the exemplary embodiment of FIG. 23 an additional stud 810 is fixed against the second stud 120. The wedge 140 is fixed using screws 160 against the studs 120, 810. The plasterboards 130, 170 are fixed against the studs using screws 160. In embodiments according of the present invention other fixing means than screws may be used. The use of fixing means allows for installing and finishing the partition wall in the same way as conventional partition walls, e.g. as the installation of conventional drywall panels. Accordingly, partition walls comprising a seismic protective structure as described herein, can be easy to install and can have the same appearance as conventional partition walls which are not provided with a seismic protective structure.

In particular embodiments of the seismic protective structure described herein, the protective board is fixed to the first and second studs using fixing means selected from the list consisting of screws, nuts and bolts, rivets, snap-fits, tacks, nails, loop fasteners, adhesives, and interlocking male/female connectors (such as fishhook connectors). A fish hook connector includes a male portion with a protrusion on its circumference. Inserting the male portion into the female portion substantially permanently locks the two portions together. Preferred fixing means include screws.

Figure 24:
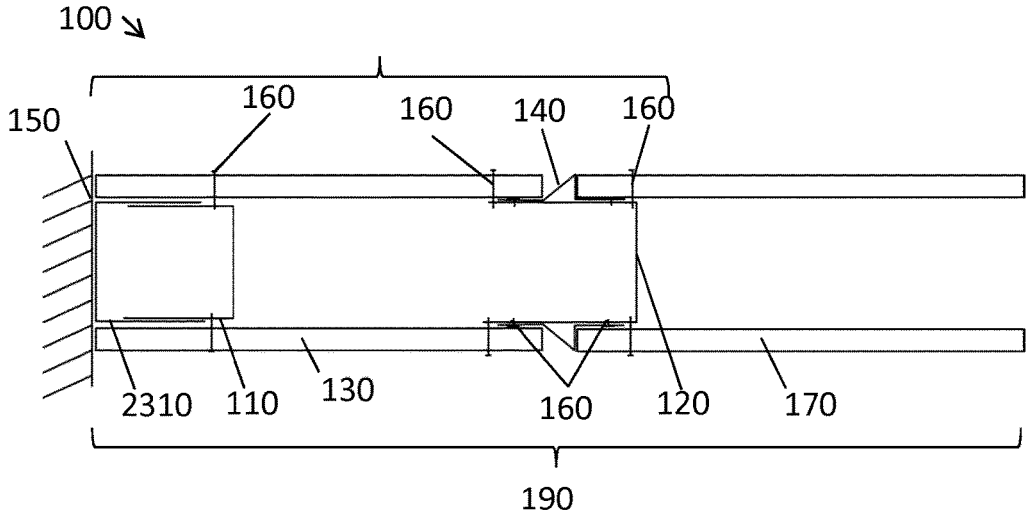
FIG. 24 provides a schematic top view of a protective structure in between a wall and the rest of the board partition in accordance with a first embodiment of the present invention.

Yet another exemplary embodiment of a seismic protective structure is illustrated in FIG. 24. This embodiment is similar as the one in FIG. 23 except that in this case no additional stud is mounted against the second stud 120. The wedge 140, the protective board 130, and the adjacent board 170 are mounted against the second stud 120.

In embodiments according to the present invention the wedge 140 may be made of any suitable material such as for example a metal based material such as steel, or galvanized steel, or stainless steel (inox), or plastic. The thickness of the material may be between 0.3 and 2 mm, preferably 0.6 mm.

Figure 2:
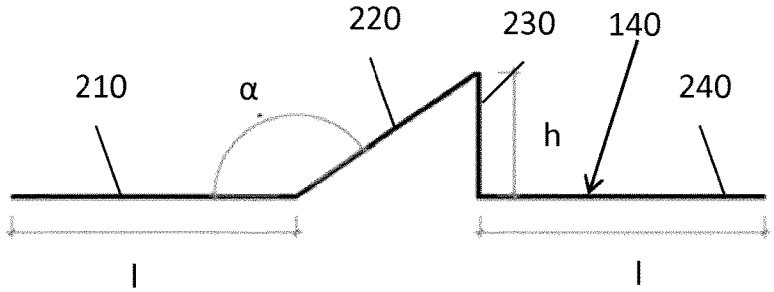
FIG. 2 provides a schematic top view of a wedge in accordance with an embodiment of the present invention.

FIG. 2 shows a top view of a wedge in accordance with embodiments of the present invention. In embodiments of the present invention, the angle of the wedge a between the first side 210 of the wedge 140 and the second side 220 of the wedge 140 is between 110° and 170°, for example between 130° and 160°, such as for example 145°. The height of the wedge h is depending on the angle of the wedge as well as on the thickness of the at least one mounted board layer, and is between 6 and 30 mm, for example between 10 and 25 mm, for example between 12.5 mm and 15 mm. The first side 210 and the fourth side 240 of the wedge are in this case in the same plane. The third side of the wedge 230 is in this case orthogonal to the fourth side 240 of the wedge and is connecting the second side 220 of the wedge and the fourth side 240 of the wedge. Whereas FIG. 2 shows a wedge wherein the cross-section is a triangle with straight edges, this is not critical. In general, any piece having a thick end having a height h and tapering to a thin edge can be used. For example, in certain embodiments of the seismic protective structure, the second side 220 may be convex or concave. In embodiments according to the present invention the length (I in FIG. 2) of the prolonged planes on both sides the wedge 140 are between 20 mm and 90 mm, for example between 30 mm and 80 mm, preferably between 40 mm and 70 mm, preferably 50 mm. These planes permit a secure mounting of the wedge against the second stud.

Figure 3:
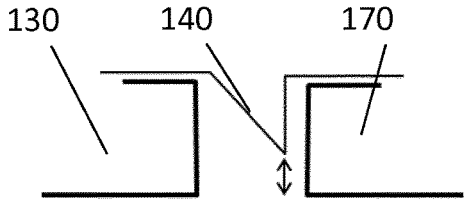
FIG. 3 and FIG. 4 provides a top view of a detail of a protective structure in accordance with an embodiment of the present invention.

In embodiments according to the present invention the height of the wedge 140 is smaller than the thickness of the at least on mounted board layer. The height of the wedge may be 1 mm, preferably 2 mm smaller than the thickness of the board which is mounted against it. An example thereof is illustrated in FIG. 3.

Figure 4:
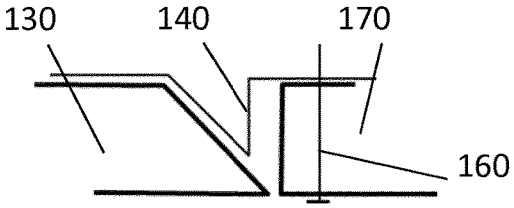

In embodiments according to the present invention the edge of the protective board 130 which is to be mounted against the wedge 140 is slanted such that, when mounted, it is parallel with the wedge. An exemplary embodiment thereof is illustrated in FIG. 4. More generally, the edge of the protective board 130 may be shaped such that when mounted, it is conformal with the wedge. For example, if the side of the wedge facing the protective board has a convex or concave surface, the edge of the protective board may have a concave or convex shape, respectively.

Figure 5:
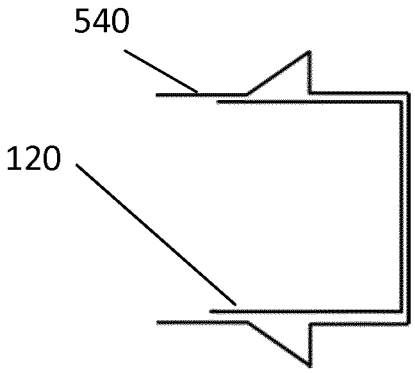
FIG. 5 provides a schematic top view of a wedge in accordance with an embodiment of the present invention.

In embodiments according to the present invention on both sides of the studs boards are mounted. In these embodiments a wedge 140 is mounted on both sides of the second stud 120 so that they can push the protective boards 130 away from the second stud when the first stud is moving in the direction of the second stud. In these embodiments both opposite wedges may be manufactured of one piece which is mountable around the second stud 120. Such a double wedge structure 540 that, when mounted 540 against the second stud 120, provides a wedge 140 on both each side of the second stud 120 is illustrated in FIG. 5. FIG. 5 shows the top view a double wedge structure 540 pushed around a second stud 120 such that a wedge 140 is present on each side of the stud.

Figure 6:
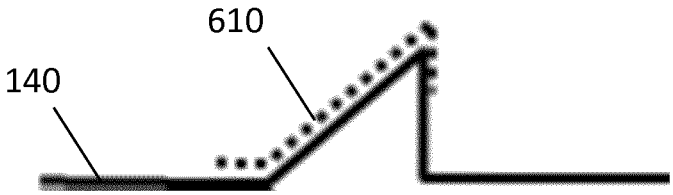
FIG. 6 provides a schematic top view of a wedge comprising a sliding layer in accordance with an embodiment of the present invention.

In embodiments according to the present invention a sliding layer 610 can be applied to the wedge 140. The sliding layer 610 may be in the form of a tape (e.g. a plastic tape). An exemplary embodiment thereof is illustrated in FIG. 6.

Figure 7:
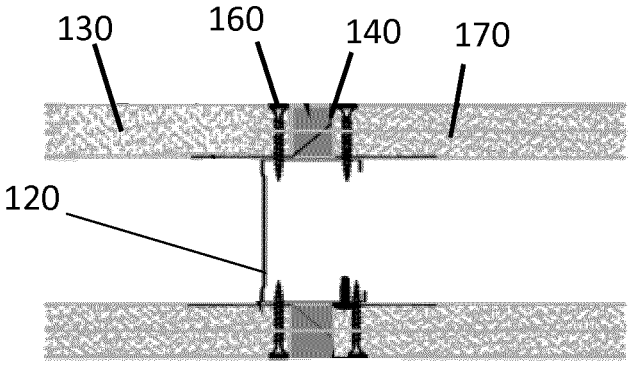
FIG. 7 provides a top view of a detail of a protective structure in accordance with an embodiment of the present invention.
Figure 25:
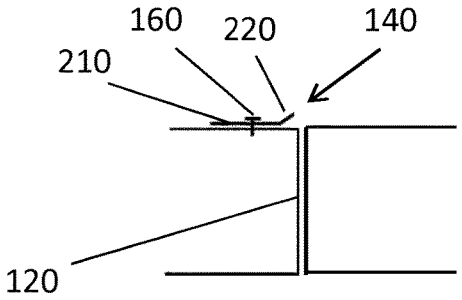
FIGS. 25 and 26 provide different wedges and the mounting thereof on a second stud in accordance with embodiments of the present invention.
Figure 26:
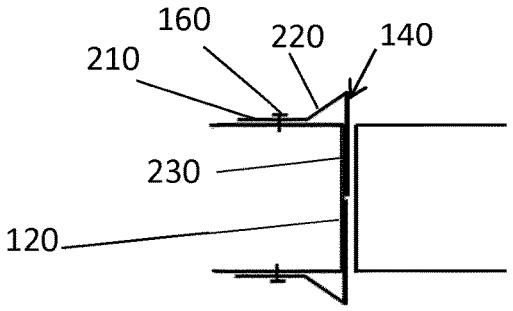

FIG. 25 and FIG. 26 show two different types of wedges 140 in accordance with embodiments of the present invention. In FIG. 25 the first side 210 of the wedge 140 is mounted against the second stud 120 using a screw 160. The wedge comprises in the example only a first side 210 and a second side 220. The wedge in FIG. 26 also comprises a third side 230 orthogonal to the first side 210. The third side 230 of the wedge 140 is oriented such that the wedge can be mounted on the second stud 210 with the first side 210 against a first side of the stud and the third side 230 against the a side orthogonal to the first side of the stud. FIG. 7 shows two mounted wedges 140 on the opposite sides of a stud 120 in accordance with an embodiment of the present invention. Protective boards 130 are mounted on one side of the wedges 140 such that the wedges force them away from the board partition when the protective boards 130 are pushed towards the wedge 140. Each of the adjacent boards 170 is mounted on the opposite side of the wedge 140 in the same plane as the corresponding protective board 130. In this particular embodiment screws 160 are used to fix the wedges 140 against the stud 120 and screws 160 are used to fix the protective boards 130, the adjacent boards 170 and the wedges 140 to the second stud 120.

Figure 8:
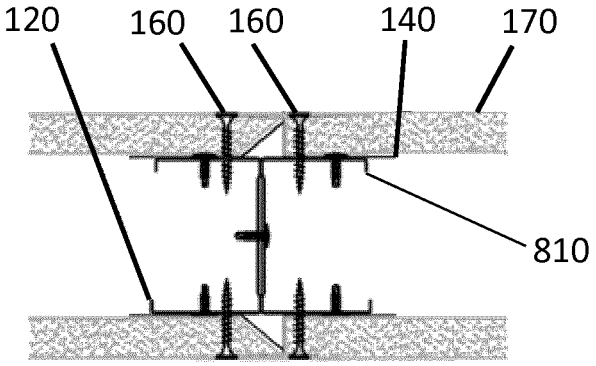
FIG. 8 provides a top view of a detail of a protective structure comprising an additional stud mounted back to back with the second stud in accordance with an embodiment of the present invention.

In the exemplary embodiment illustrated in FIG. 8 the wedges 140 are mounted against two studs (120, 810) which are mounted back to back. An additional stud 810 is fixed against the second stud 120 (e.g. by means of a screw). The additional stud 810 may have a length corresponding with the length of the wedge 140. In the exemplary embodiment of FIG. 8 the wedges 140 are screwed against the second stud 120 and the additional stud 810 before screwing the protective boards 130 and the adjacent boards 170 against the second stud and the additional stud.

Figure 9:
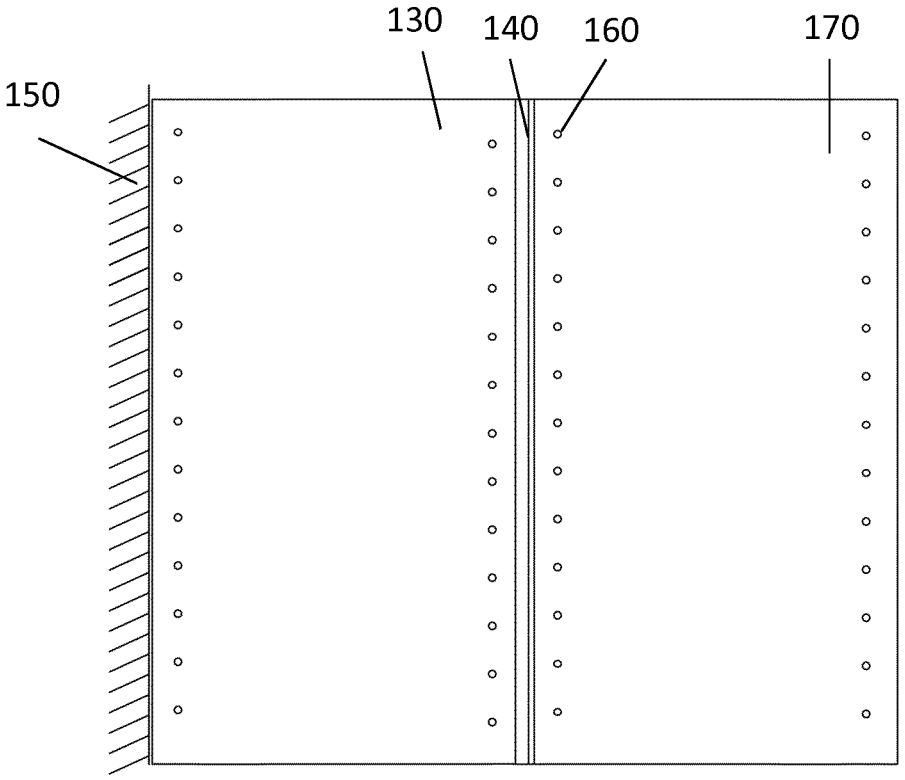
FIG. 9 provides a schematic front view of a board partition comprising a protective structure in accordance with embodiments of the present invention.

FIG. 9 shows a schematic drawing of a board partition 190 comprising a protective board 130 and a wedge 140 in accordance with embodiments of the present invention. The protective board 130 is mounted using screws 160 to a first stud 110 and to the wedge 140 and/or to the second stud 120. This stud 110 is mounted against a wall 150. The protective board 130 is also mounted against a second stud 120 on which a wedge 140 is mounted. In this exemplary embodiment of the present invention the wedge 140 has (about) the same length as the second stud 120.

The wedge may be formed as a single piece, or be formed from a plurality of parts, wherein each part contributes to a part of the total length of the wedge. The different parts can then be mounted on the second stud as to form a single continuous wedge. Alternatively, a plurality of wedges may be positioned along the length of the second stud, with a gap between the individual wedges. The plurality of wedges thus can form a "discontinuous" or "intermittent" wedge. The number of screws for fixing the protective board against the wedge could be reduced. This may allow easier pushing the protective board out of the plane of the board partition wall.

Figure 10:
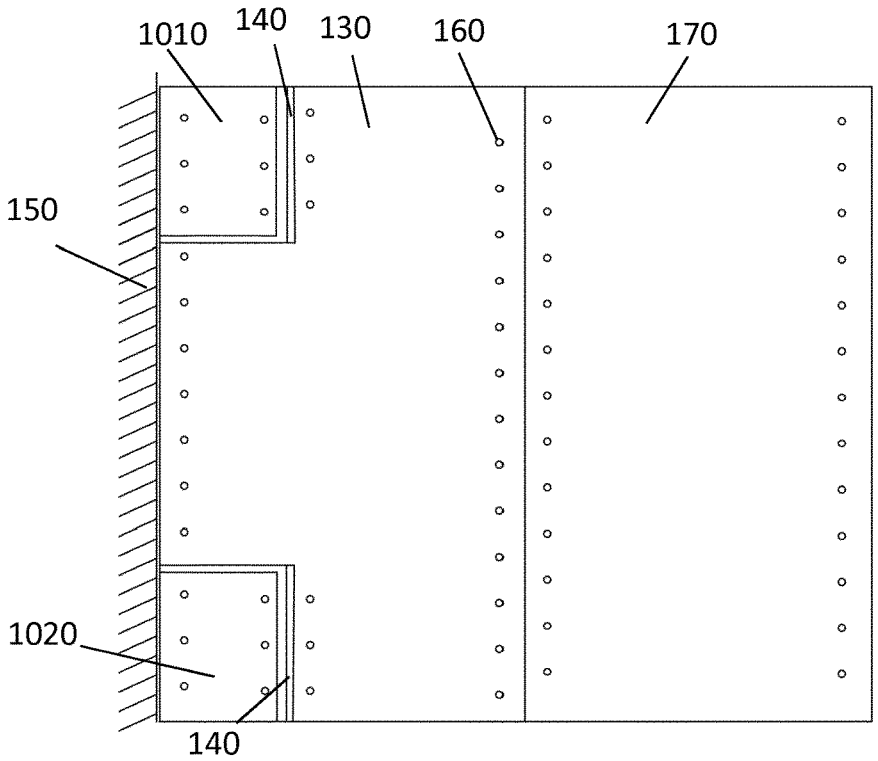
FIG. 10 provides a schematic front view of a board partition comprising a protective structure comprising upper and lower corner parts in accordance with an embodiment of the present invention.

In certain embodiments according to the present invention, the wedges 140 are not positioned over the complete height of the protective board 130. In embodiments according the present invention the length of the wedge 140 is smaller than the height of the protective board 130. In embodiments according to the present invention the second stud 120 is not positioned at an outer side of the protective board 130 but more closely to the first stud 110. Positioning of the second stud 120 and the wedges 140 is done such that only part of the protective board 130 is moved away from the board partition 190 when the first stud 110 is moving towards the second stud 120. In embodiments according to the present invention the protective board 130 is partitioned into parts 1010, 1020. A first corner part 1010 is located in the upper corner of the protective board which is closest to the wall, a second corner part 1020 is located in the lower corner of the protective board which is closest to the wall. An example thereof is illustrated in the schematic drawing of FIG. 10.

Accordingly, in particular embodiments, the protective board 130 may comprise a first corner part 1010 and a second corner part 1020. More particularly, the protective board may comprise a first corner part, a second corner part, and at least one intermediate part which separates the first corner part from the second corner part. Accordingly, the at least one intermediate part is at least partially located between the first corner part and the second corner part.

It is preferred that only the upper corner part and/or lower corner part is pushed out of the plane of the board partition, thus leaving the remainder of the partition wall intact. Preferably, the upper corner part and/or lower corner part will be separated at least partially from the remainder of the partition wall when a given level of seismic stress is appearing. More particularly, the upper and/or lower corner part are separated at least partially from the at least one intermediate part of the protection board.

Typically, for each of the first and second corner parts, a first side of the corner part is mounted to the first stud, whereas an opposing side of the corner part is mounted to the second stud. It is further provided that each of the upper corner part and the lower part may be provided with its own (dedicated) wedge. More particularly, the upper corner part may be provided with an upper wedge, whereas the lower corner part is provided with a lower wedge. The upper wedge and lower wedge are separate wedges (i.e. do not form a single continuous wedge). The upper and lower wedges may be provided as separate parts, or may be provided as a single part, e.g. on a single profile.

Preferably, the wedges are preferably only provided along the corner parts, and not along other parts of the protective board.

In particular embodiments, the upper corner part (1020) and/or the lower corner part (1020) may be provided as separate parts. For example, the protective board may be formed out of different parts, which are joined together (with an intermediate part) prior to or during installation of the partition wall. This facilitates controlling the damage to the partition wall under seismic stress. Alternatively, the protective board may be provided as a single piece, wherein the corner parts are connected to the remainder of the protective board (more particularly the at least one intermediate part) via a weakened connection, e.g. a thinner and/or perforated part of the protective board.

In certain embodiments, one of the upper and lower corner parts may be provided as a separate part, wherein the other one of the upper and lower corner parts may be connected to the remainder of the protective board (more particularly the at least one intermediate part) via a weakened connection. Accordingly, in particular embodiments, the protective board may comprise an intermediate part and at least one separate corner part.

The first corner part 1010 and the second corner part 1020 may have a height between 0.1 times the height of the protective board and 0.3 times the height of the protective board, preferably 0.2 times the height of the protective board 130. More particularly, the first corner part 1010 and the second corner part 1020 may have a height between 0.1 times the height of the partition wall and 0.3 times the height of the partition wall, preferably 0.2 times the height of the partition wall.

The protective corner parts may be rectangular whereby the width is ranging between 100 and 1200 mm, for example between 150 mm and 1000 mm, for example between 300 mm and 900 mm, for example between 300 mm and 800 mm, for example between 400 mm and 600 mm. The corner parts 1010, 1020 are mounted on one side against the first stud 110, and on the other side against a wedge 140 which is mounted against the second stud 120. They may be fixed using screws 160 against the first stud 110 and against the wedge 140 and/or against the second stud 120.

Figure 11:
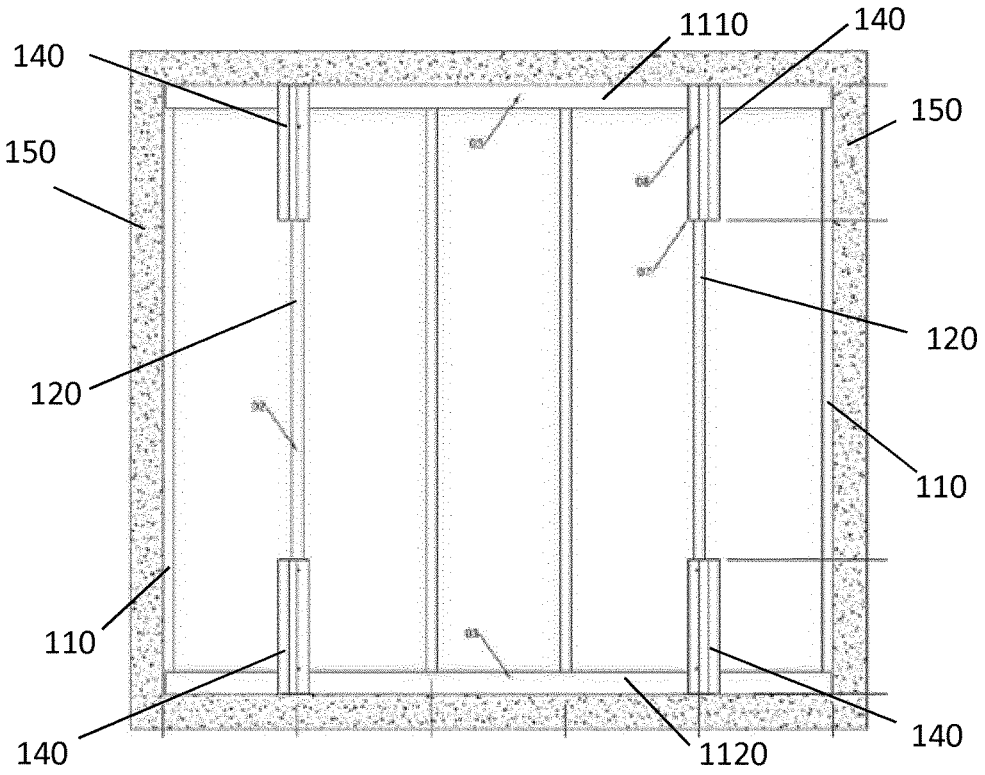
FIG. 11 provides a technical drawing of the studs and wedges of a board partition in accordance with an embodiment of the present invention.
Figure 12:
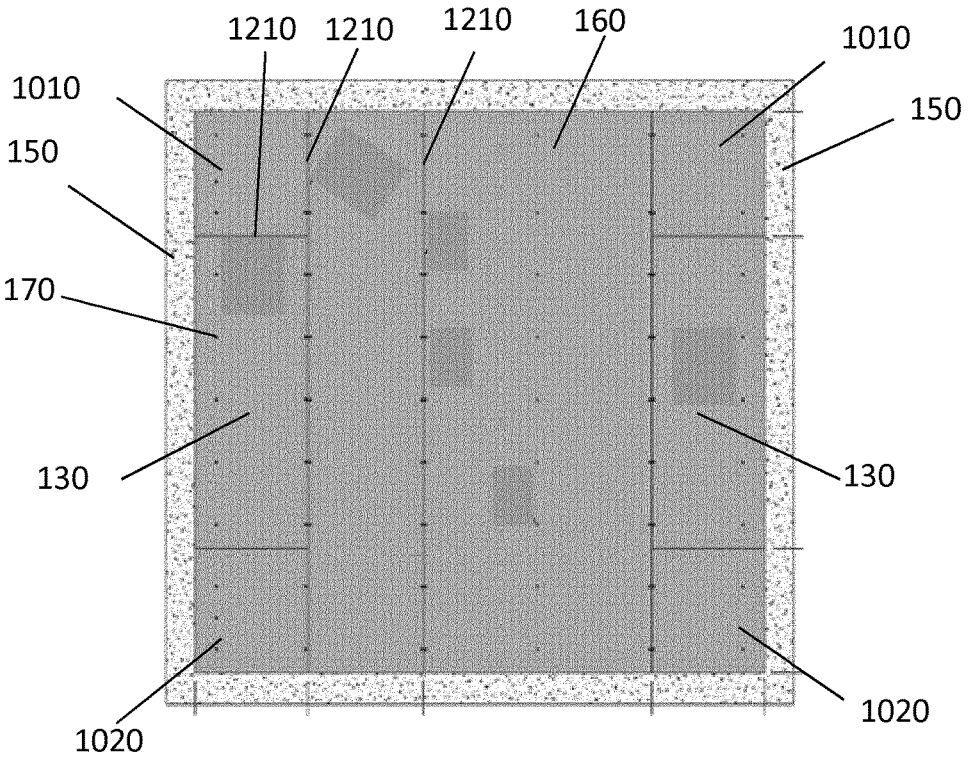
FIG. 12 provides a technical drawing of a board partition whereby a first layer of boards is mounted on a structure as in FIG. 11 in accordance with an embodiment of the present invention.

FIG. 11 shows a technical drawing of the studs and wedges of a board partition in accordance with an embodiment of the present invention. On the left side, as well as on the right side a first stud 110 is mounted against a wall 150. Second studs 120 are positioned next to the first studs 110. Wedges 140 are positioned at the upper side and the lower side of the second studs 120. In embodiments according to the present invention the studs have a depth (measured orthogonally to the board partition surface) between 50 and 150 mm, for example 50 mm and a width (measured horizontally and parallel with the board partition surface) ranging between 30 mm and 70 mm. In embodiments according to the present invention the vertical studs are mounted in horizontal tracks (1110, 1120). The tracks (1110, 1120) are mounted against the floor and the ceiling. The tracks have a depth (measure orthogonally to the board partition surface) ranging between 50 and 150 mm. The depth of the tracks and the depth of the studs are such that the studs fit tight in the tracks. The tracks have a width (measured vertically and parallel with the board partition surface) ranging between 30 mm and 100 mm. In embodiments according to the present invention thickness of the tracks and studs is ranging between 0.4 and 1.2 mm, for example between 0.5 and 0.8 mm, such as for example 0.6 mm An example of mounted boards is illustrated in FIG. 12. A protective board 130 is mounted against the first stud 110 and the second stud 120. The protective board 130 comprises a first corner part 1010, a second corner part 1020 and the rest of the board. These are individual parts which as a whole are forming a complete board. The first corner part 1010 is the upper corner part and is mounted against the first stud 110 and the wedge 140 which is mounted against the second stud 120. The second corner part 1020 is the lower corner part and is mounted against the first stud 110 and the wedge 120 which is mounted against the second stud. The corner parts 1010, 1020 of the protective boards 130 are positioned in the corners of the board partition 190. Together with the rest of the protective boards these corners form two protective boards 130. In between the protective boards 130 the adjacent boards 170 are mounted forming the complete board partition 190. The boards may be plasterboards. The plasterboards may be fire resistant plasterboards or any other type of gypsum boards. In embodiments according to the present invention the height of the boards have a height between 1.5 m and 3 m, for example between 2.4 m and 2.8 m. The width of the boards may be between 500 mm and 2000 mm, for example between 1000 mm and 1400 mm, for example between 1200 and 1250 mm. The thickness of the board may be between 6 mm and 25 mm, for example between 10 mm and 15 mm, for example 12.5 mm. The boards may be connected against the studs using screws 160. These screws may have different lengths (e.g. 25 mm, 45 mm). The distance between the different screws along a stud may for example be between 200 mm and 400 mm, for example 300 mm. These screws 160 may also be used for connecting a wedge 140 against a second stud 120. The screws may be self-tapping screws. A mesh tape 1210 may be used for reinforcing the joint between two adjacent boards.

Figure 13:
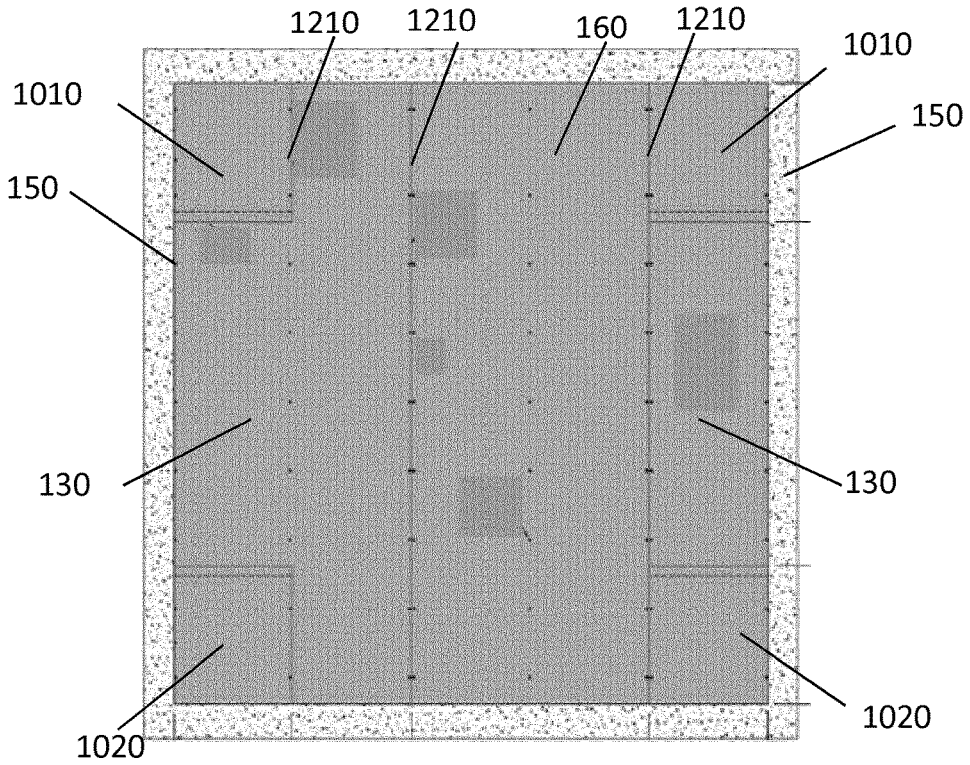
FIG. 13 provides a technical drawing of a board partition whereby a second layer of boards is mounted on a structure as in FIG. 11 in accordance with an embodiment of the present invention.

The board partition 190 may comprise multiple layers of boards. The height of the wedge 140 is thereby adapted to the total thickness of the multiple layers of boards such that the height of the wedge is always smaller than the thickness of the one or multiple layers of boards (e.g. 2 mm smaller). In FIG. 13 a second layer of boards is added to the board partition 190.

Figure 14:
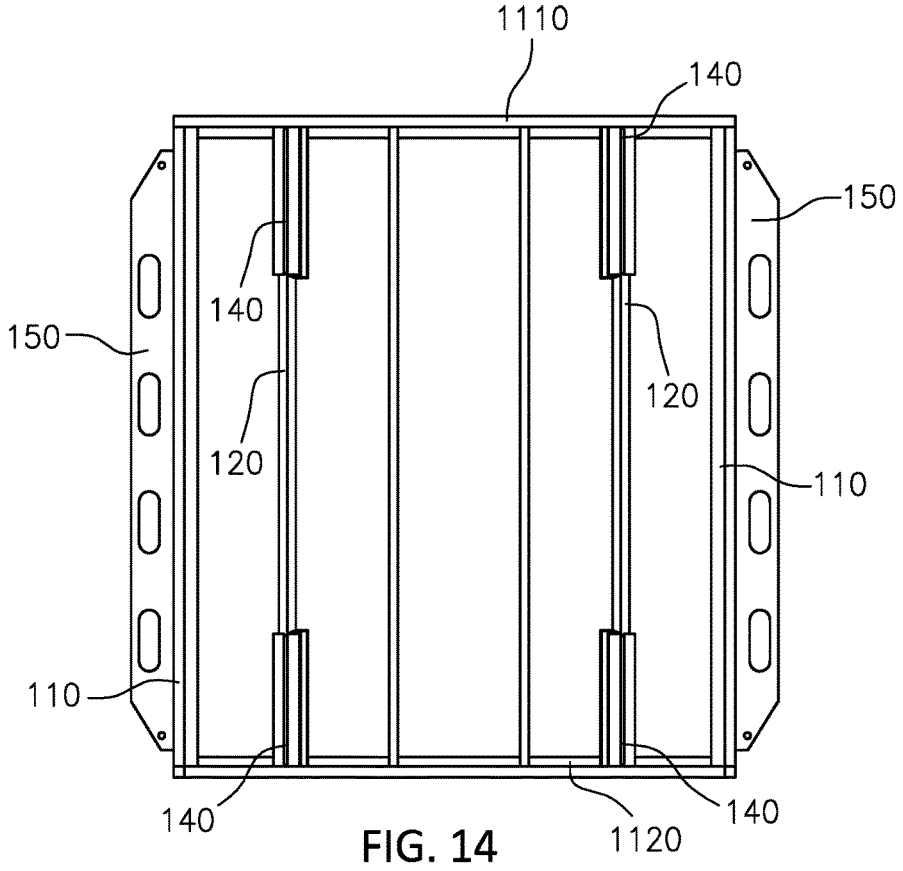
FIG. 14 shows a picture of a frame of studs in accordance with an embodiment of the present invention.
Figure 15:
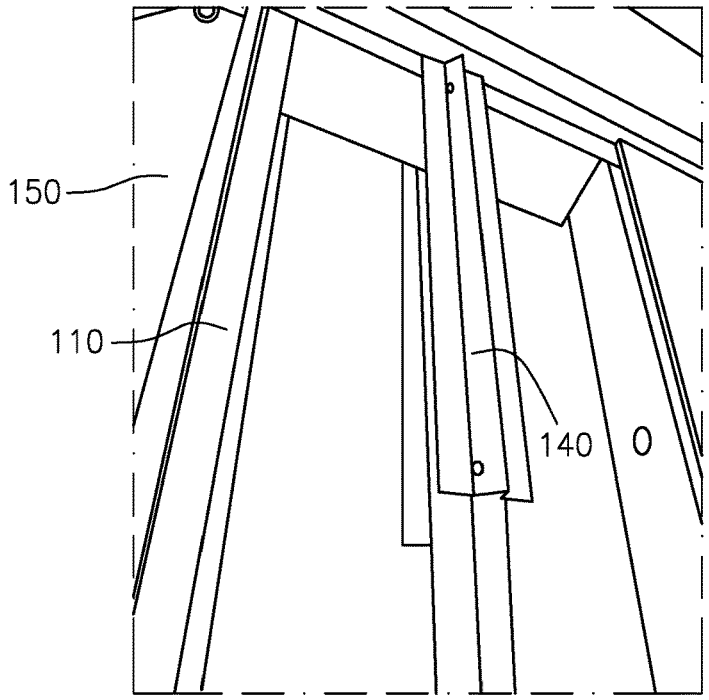
FIG. 15 shows a close up of a mounted wedge on a second stud in accordance with an embodiment of the present invention.
Figure 16:
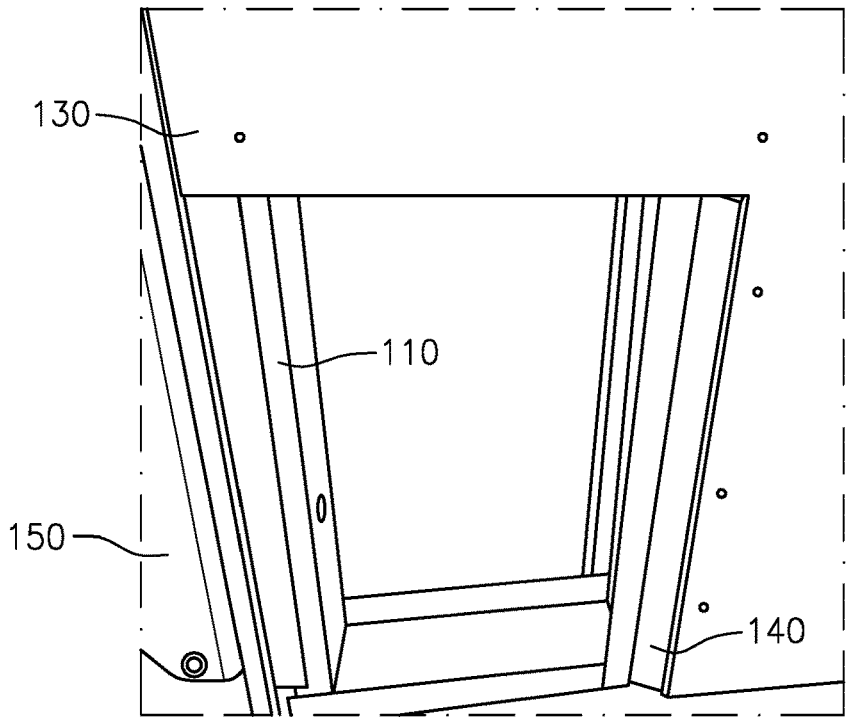
FIG. 16 shows a close-up picture of a frame of studs on which some boards are mounted in accordance with an embodiment of the present invention.
Figure 17:
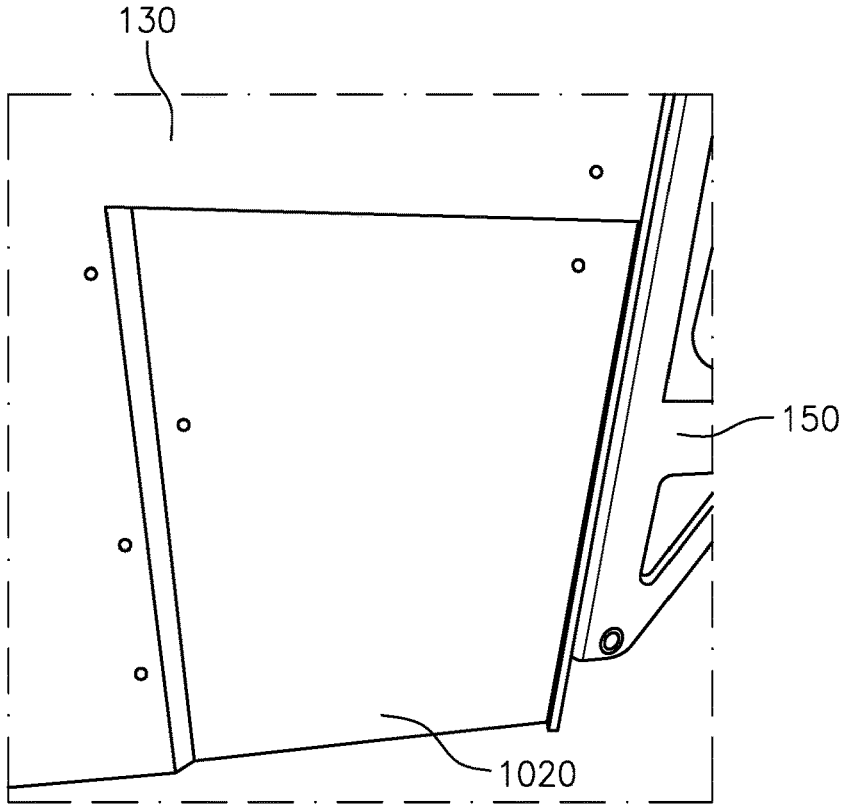
FIG. 17 shows a close-up picture of a board partition where the lower corner part of the protective board is mounted in accordance with an embodiment of the present invention.

FIG. 14 shows a picture of a frame of studs in accordance with an embodiment of the present invention. The first studs 110, second studs 120, and wedges 140 are visible in the picture. In the picture of FIG. 14 the frame of studs is mounted between mechanical movable walls 150. These walls permit experiments whereby the effect of wall movements caused by earthquakes on a board partition 190 can be tested. Embodiments according to the present invention are tested using this setup to study how much they are protecting board partitions 190 against damage. Thereby it is preferable that only the protective board 130 gets damaged and that the adjacent boards do not get damaged. FIG. 15 shows a close up of a mounted wedge 140 on a second stud 120 in accordance with an embodiment of the present invention. FIG. 16 shows a close-up picture of a frame of studs on which some boards are mounted. The lower corner part 1020 of the protective board 130 is not yet mounted. This makes that the wedge 140, part of the first stud 110 and part of the second stud 120 are still visible. FIG. 17 shows a picture where the lower corner part 1020 of the protective board 130 is mounted. In this embodiment of the present invention the goal is to make two layers of boards. Only one of the two boards of the lower corner part 1020 are mounted in the setup illustrated in this picture.

Figure 18:
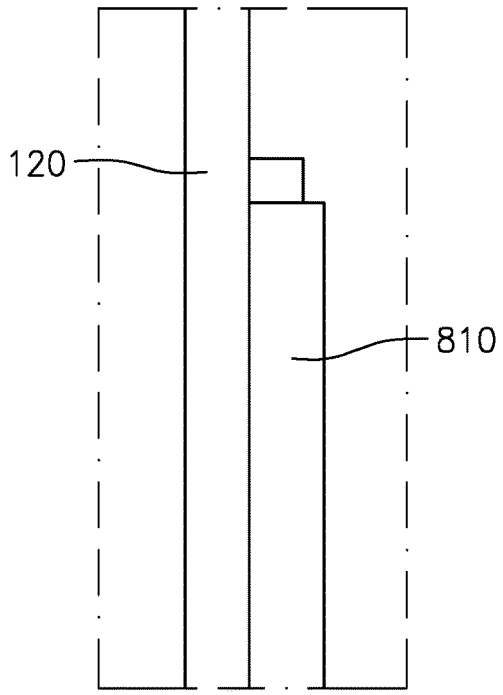
FIG. 18 shows a picture of an additional part mounted back to back with the second stud in accordance with an embodiment of the present invention.
Figure 19:
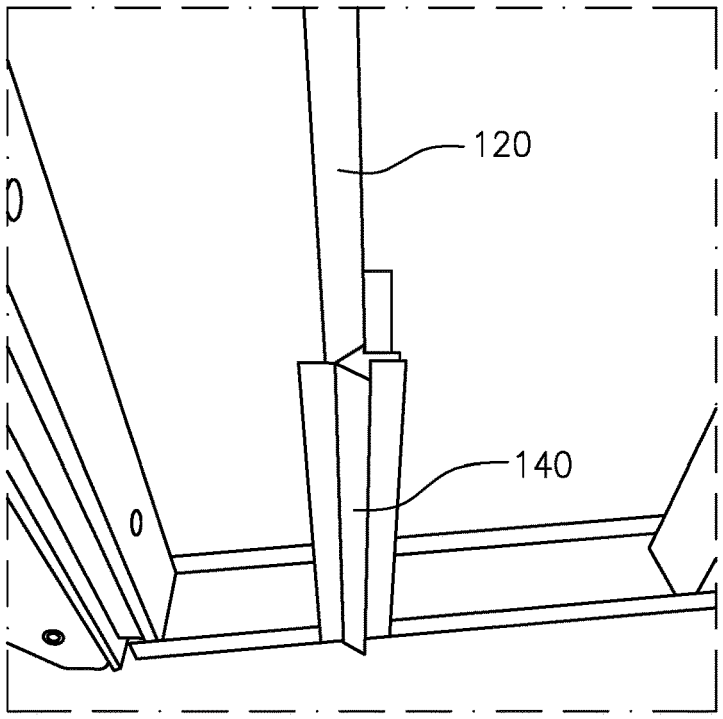
FIG. 19 shows a picture of a wedge mounted on a second stud and on an additional part in accordance with an embodiment of the present invention.

In particular embodiments of the present invention an additional part 810 is mounted back to back with the second stud 120. A picture thereof is illustrated in FIG. 18. The length and positioning of the additional part is such that the wedge 140 can be mounted against both the second stud 120 and the additional part 810. This is depicted in FIG. 19.

Tests have been performed on a board partition with a similar frame as in FIG. 14 whereby a double layer of fire boards are mounted on the frame. The protective boards 130 are comprising an upper corner part 1110 and a lower corner part 1120.

The tests have been performed on frames having studs:

with a depth of 50 mm and a width of 70 mm (first board partition setup), with a depth of 50 mm and a width of 150 mm (second board partition setup), with a depth of 50 mm and a width of 150 mm, and comprising a sliding system mounted on the vertical structure (third board partition setup).

In the tests the height of the board partition 190 is 2.7 meters and the width is 3 meters. The second stud 120 is positioned at a distance of 600 mm from the first stud 110. The wedges are positioned at the top and bottom of the second studs 120. The corner parts 1010, 1020 of the protective boards 130 are mounted against the first stud 110 on one side and against the wedge 140 on the other side. In the test setup the corner parts are 600 mm by 600 mm. In the test setup the boards are positioned as follows:

First layer: 3 columns of board with a width of 600 mm and 1 full size board with a width of 1200 mm (FIG. 12), Second layer 2 columns with a width of 1200 mm, and one column with a width of 600 mm (FIG. 13). Corner parts are placed in the upper and lower corners.

The two layers are staggered. The first layer is screwed at 600 mm centre and the second at 300 mm centre.

In the test setup the board partition leaves no gaps in the lateral structure. In the test setup the boards are not screwed to the horizontal tracks at the top and the bottom.

Figure 20:
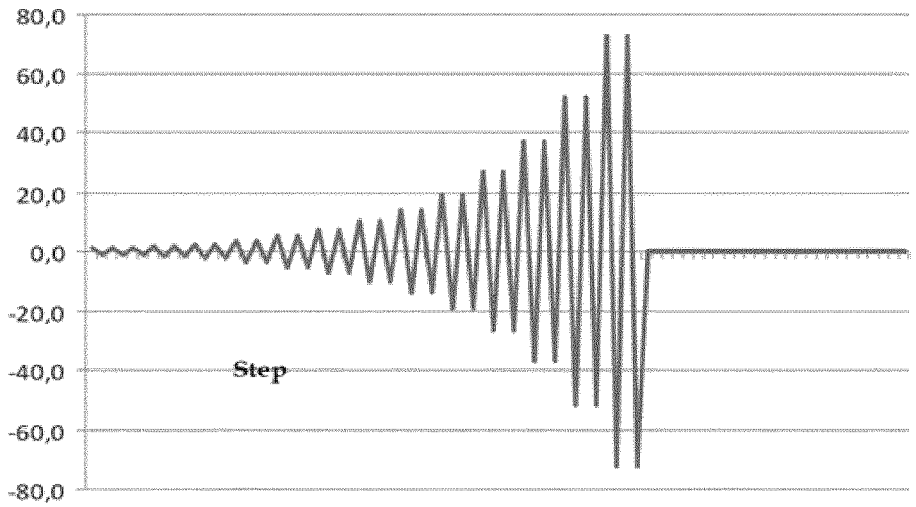
FIG. 20 shows the wall displacement in function of the step number for a test on a board partition comprising a protective structure in accordance with an embodiment of the present invention.
Figure 21:
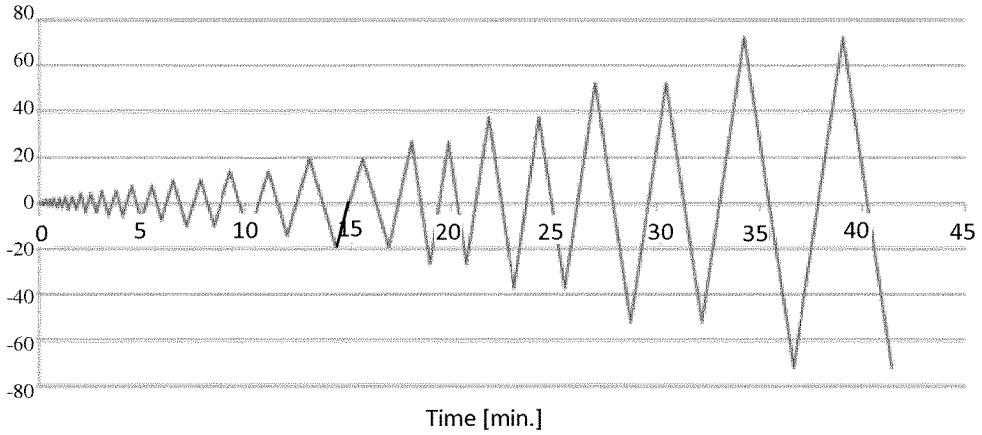
FIG. 21 shows the wall displacement in function of time for a test on a board partition comprising a protective structure in accordance with an embodiment of the present invention.

During the tests the left wall and the right wall are alternatingly moved closer to each other and further away from each other. The displacement of the walls 150 is illustrated in FIG. 20 in function of the step number. The vertical axis corresponds with the displacement of the wall 150 from left to right and from right to left starting from an initial position at zero displacement. The displacement is expressed in millimeter. The top of the partition may be fixed and does not move, whereas the bottom part is cycled from left to right and right to left with increasing displacement. As can be seen from FIG. 20 the maximum displacement in the test is 70 mm. The tests performed comply with the FEMA 461/June 2007 regulation. The displacement of the walls during the tests is also illustrated in FIG. 21. In this figure the displacement is illustrated in function of time expressed in minutes. The vertical axis is expressed in millimeters.

Figure 22:
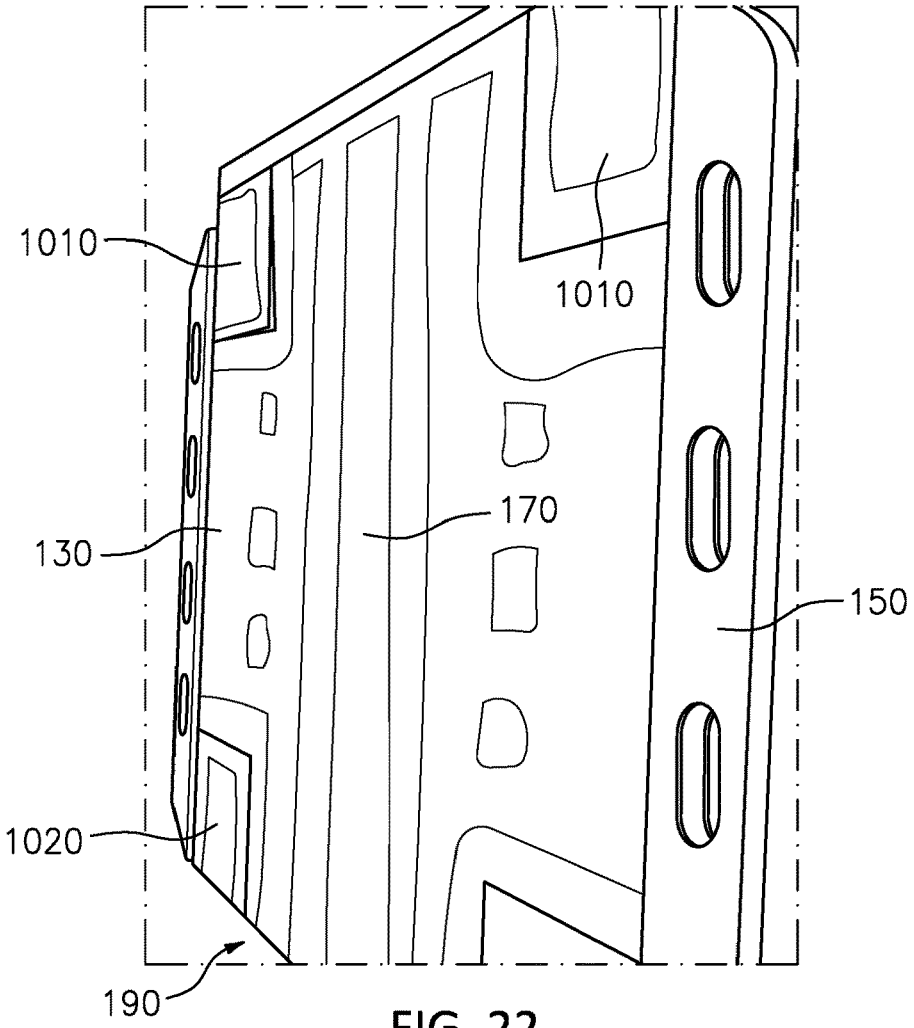
FIG. 22 shows a board partition, after being submitted to a test, with a damaged protective upper corner part in accordance with an embodiment of the present invention.

In the first board partition setup the test is performed until a displacement of 5.1 cm. When increasing the displacement the joints of the corner parts 1010, 1020 near the wedges 140 start cracking. In the first partition setup this starts as from a displacement of 1.39 cm which is 0.51% of the height (2.7 m) of the board. In this test the upper corner parts 1010 are pushed by their corresponding wedges 140 out of the plane of the board partition 190 at a displacement of 3.7 cm (1.37% of the height). In this test the adjacent boards were damaged and the second stud buckled at a displacement of 5.1 cm (1.88 percent of the height). It is an advantage of embodiments of the present invention that the protective board breaks before the additional boards break and before the studs buckle. It is an advantage of embodiments of the present invention that breaking of the protective boards increases the displacement threshold above which the rest of the board partition starts breaking. It is an advantage of embodiments of the present invention that only the protective board needs to be replaced if the displacement is small enough to prevent buckling of the studs and breaking of the adjacent boards. An example of a displaced corner part 1010 of a protective board 130 is shown in the picture of FIG. 22. It shows an upper corner part which is pushed out of the plane of the board partition. The joint between the upper corner part and the rest of the board partition is broken. As can be seen from the figure the adjacent board 170 is not damaged.

In the second board partition setup the width of the studs is 150 mm instead of 70 mm. This increases the strength of the board partition and therefore the joints of the corner parts 1010, 1020 only start cracking at 0.7 cm (0.25%) displacement. Increasing the displacement causes additional cracks in the corner parts 1010, 1020, and causes the corner parts of the protective boards 130 to be pushed out of the plane of the board partition 190 by the wedges 140. At a displacement of 5.1 cm (1.88%) the adjacent boards 170 and studs get damaged.

It is an advantage of embodiments of the present invention that below a threshold of the wall 150 displacement only the protective boards 130 are damaged and thus only these need to be replaced. It is an advantage of embodiments of the present invention that the protective boards 130 break first, thereby releasing pressure from the rest of the board partition 190.

In the third board partition setup the width of the studs is 150 mm and the board partition setup is comprising a sliding system. The test is performed until a displacement the walls 150 of 7.19 cm. The first cracks on the corner parts 1010, 1020 only start appearing at 0.72 cm (0.26%). All the corner parts tear off after a displacement of 5.1 cm (1.88%). The test is repeated with a maximum displacement of 7.19 cm (2.66%) and no additional damage occurs. After replacing the corner parts 1010, 1020 and filling of the joints the test is repeated and the corner parts 1010, 1020 are again protecting the board partition from breaking by breaking first under the displacement of the outer walls 150. Also during his test the four corner parts 1010, 1020 tear off under influence of the displacement of the walls 150.

For the different board partition setups under the previous tests, the board partition setups were protected by the protective structures up until a displacement of 1.88%. This threshold may be different for a different board partition setup.

It is an advantage of embodiments of the present invention that the wedges 140 brake away the corner parts 1010, 1020 of the protective boards 130 and thereby relief the pressure from the rest of the board partition.

In a second aspect the present invention relates to a board partition 190 comprising a seismic protective structure 100 in accordance with embodiments of the present invention.

In a third aspect the present invention relates to a kit of parts for constructing a seismic protective structure 100. The kit of parts comprises one or more wedges 140, at least one protective board 130, a first stud 110, and a second stud 120. The constructed seismic protective structure is adapted for intentionally causing damage to the protective board 130 when a given level of seismic stress is appearing. When the protective board 130 is damaged, stress is relieved from the rest of the board partition. The protective board may comprise an upper corner part 1010 and/or a lower corner part 1020 whereby these parts are damaged first under seismic stress.

In a fourth aspect the present invention relates to a method for protecting a board partition 190 against a given level of seismic stress. The method comprises using a seismic protective structure 100, in accordance with embodiments of the present invention, in the board partition 190. The seismic protective structure is used such that, when a given level of stress is appearing, damage is intentionally caused to the protective board 130 of the seismic protective structure 100 thereby releasing pressure from the remainder of the board partition 190.

In a fifth aspect the present invention relates to a method for restoring a board partition 190 after an earthquake. The board partition comprises a seismic protective structure 100 in accordance with embodiments of the present invention. The method comprises replacing the protective board 130 or the upper 1010 or lower part 1020 of the protective board.

The invention claimed is:

1. A seismic protective structure (100) for protecting a board partition (190), the protective structure (100) comprising:

a first stud (110) and a second stud (120), the first stud (110) being mounted against a neighbouring wall (150) and the second stud (120) being positioned spaced from the first stud, a protective board (130) mounted on the first stud (110) and the second stud (120), and a wedge (140) mounted and positioned against the second stud (120) such that the protective board (130) mounted on the first and second studs (110, 120) is pushed at least partly out of a plane of the board partition (190) by the wedge (140) at a given level of seismic stress, wherein said protective board (130) is fixed on the first stud (110) and the second stud (120) via fixing means.

2. The seismic protective structure (100) according to claim 1, wherein the fixing means are screws.

3. The seismic protective structure (100) according to claim 1, wherein said seismic protective structure is configured, at the given level of stress, to intentionally damage the protective board (130), thereby releasing pressure from a remainder of the board partition (190).

4. A The seismic protective structure (100) for protecting a board partition (190), the protective structure (100) comprising:

a first stud (110) and a second stud (120), the first stud (110) being mounted against a neighbouring wall (150) and the second stud (120) being positioned spaced from the first stud, a protective board (130) mounted on the first stud (110) and the second stud (120), and a wedge (140) mounted and positioned against the second stud (120) such that the protective board (130) mounted on the first and second studs (110, 120) is pushed at least partly out of a plane of the board partition (190) by the wedge (140) at a given level of seismic stress, wherein length of the wedge (140) is smaller than height of the protective board (130).

5. A seismic protective structure (100) for protecting a board partition (190), the protective structure (100) comprising:

a first stud (110) and a second stud (120), the first stud (110) being mounted against a neighbouring wall (150) and the second stud (120) being positioned spaced from the first stud, a protective board (130) mounted on the first stud (110) and the second stud (120), and a wedge (140) mounted and positioned against the second stud (120) such, that the protective board (130) mounted on the first and second studs (110, 120) is pushed at least partly out of a plane of the board partition (190) by the wedge (140) at a given level of seismic stress, wherein an edge of the protective board (130), or a corner part (1010, 1020) thereof, is slanted to be parallel with the wedge (140) when mounted against the wedge (140).

6. A The seismic protective structure (100) for protecting a board partition (190), the protective structure (100) comprising:

a first stud (110) and a second stud (120), the first stud (110) being mounted against a neighbouring wall (150) and the second stud (120) being positioned spaced from the first stud, a protective board (130) mounted on the first stud (110) and the second stud (120), and a wedge (140) mounted and positioned against the second stud (120) such that the protective board (130) mounted on the first and second studs (110, 120) is pushed at least partly out of a plane of the board partition (190) by the wedge (140) at a given level of seismic stress, wherein the protective board (130) comprises an upper (1010) and a lower (1020) corner part mounted against the first stud (110) and the second stud (120) such that the wedge (140) pushes at least one of the upper corner part (1010) and the lower corner part (1020) out of the plane of the board partition (190) at the given level of seismic stress.

7. The seismic protective structure (100) according to claim 6, wherein said wedge (140) is provided only along at least one of said upper and lower corner parts pact (1010, 1020).

8. The seismic protective structure (100) according to claim 6, wherein height of at least one of the upper and the lower corner part (1010, 1020) is 0.1 to 0.3 times height of the board partition (190).

9. The seismic protective structure (100) according to claim 6, wherein said protective board (130) is configured such that at least one of said upper corner part (1010) and said lower corner part (1020) is at least partially separated from a remainder of the protective board (130), when pushed out of the plane of the board partition (190).

10. The seismic protective structure (100) according to claim 9, wherein at least one of, said upper corner part (1020) and said lower corner part (1020) is provided as separate parts.

11. A board partition (190) comprising the seismic protective structure (100) according to claim 1.

12. The board partition (190) according to claim 11, wherein the board partition (190) is double sided having the protective board (130) at each side of the board partition (190), the board partition (190) comprises four said seismic protective structures (100) each comprising a double wedge structure, and said wedges (140) are present on both sides of the board partition (190) and in each corner of the protective boards (130).

13. A kit of parts configured to construct the seismic protective structure (100) according to claim 1, wherein the kit of parts comprises one or more said wedges (140), at least one said protective board (130) comprising an upper corner part (1010) and a lower corner part (1020), the first stud (110), and the second stud (120) for constructing the board partition adapted for pushing at least one of the upper corner part (1010) and the lower corner part (1020) of the protective board at least partly out of the plane of the board partition (190) by the wedge at the given level of seismic stress.

14. A method of protecting a board partition (190) against a given level of seismic stress, the method comprising using the seismic protective structure (100) as recited in claim 1, in the board partition (190) such that at the given level of seismic stress, the protective board is pushed at least partly out of the plane of the board partition (190) by the wedge mounted on the second stud of the seismic protective structure (100).

15. A method of restoring a board partition (190) after an earthquake, the board partition comprising the seismic protective structure (100) as recited in claim 1, the method comprising replacing only the protective board (130) being part of the seismic protective structure (100) or replacing only an upper (1010) or a lower part (1020) of the protective board being part of the seismic protective structure (100).

* * * * *